US012571408B2

(12) United States Patent
Patton et al.

(10) Patent No.: US 12,571,408 B2
(45) **Date of Patent: *Mar. 10, 2026**

(54) SPLIT VOLUTE FOR SUBMERSIBLE PUMP

(71) Applicant: INDUSTRIAL FLOW SOLUTIONS OPERATING, LLC, New Haven, CT (US)

(72) Inventors: Ken Patton, New Haven, CT (US); Kiritkumar Patel, New Haven, CT (US)

(73) Assignee: INDUSTRIAL FLOW SOLUTIONS OPERATING, LLC, New Haven, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/473,238

(22) Filed: Sep. 23, 2023

(65) Prior Publication Data

US 2024/0159246 A1 May 16, 2024

Related U.S. Application Data

(63) Continuation of application No. 18/054,358, filed on Nov. 10, 2022, now Pat. No. 11,835,061.

(51) Int. Cl.
*F04D 29/44* (2006.01)
*F04D 7/04* (2006.01)
(Continued)

(52) U.S. Cl.
CPC ..... *F04D 29/445* (2013.01); *F04D 7/045* (2013.01); *F04D 29/2288* (2013.01); *F04D 29/426* (2013.01); *F04D 29/628* (2013.01)

(58) Field of Classification Search
CPC ... F04D 7/02; F04D 7/04; F04D 7/045; F04D 29/2288; F04D 29/40; F04D 29/406; F04D 29/426; F04D 29/4293; F04D 29/628
See application file for complete search history.

(56) References Cited

U.S. PATENT DOCUMENTS 4,728,256 A * 3/1988 Araoka ..... E02F 3/925 415/121.2
5,074,764 A * 12/1991 Kobayashi ..... F04D 7/04 417/423.9

(Continued)

FOREIGN PATENT DOCUMENTS

CN 106762693 A * 6/2017 ..... F04D 13/06
CN 207454308 U * 6/2018

OTHER PUBLICATIONS

CN-207454308-U translation; Published Jun. 5, 2018 (Year: 2018).*
CN-106762693-A translation; Published May 31, 2017 (Year: 2017).*

*Primary Examiner* — Justin D Seabe
(74) *Attorney, Agent, or Firm* — Wasserbauer Law, LLC; Nicholas E. Blanton, Esq.; Damian G. Wasserbauer, Esq.

(57) ABSTRACT

A split volute for a centrifugal pump is disclosed that provides a manufacturing advantage by improving the yield of high-chrome iron casting, providing for full surface coating capability using line-of-sight spray coating systems. Performance improvements include improved pump efficiency, abrasion resistance, and volute lifetime. Additional operational cost savings are enabled through reduced time required for common volute maintenance procedures and an increased replacement interval for the volute. Taken together, these advantages reduce the total cost of ownership of the split volute pump system.

16 Claims, 10 Drawing Sheets

(51) Int. Cl.

| | |
|---|---|
| ***F04D 29/22*** | (2006.01) |
| ***F04D 29/42*** | (2006.01) |
| ***F04D 29/62*** | (2006.01) |

(56) References Cited

U.S. PATENT DOCUMENTS

| | | | | |
|---|---|---|---|---|
| 5,238,363 | A * | 8/1993 | Thielke | F04D 7/045 366/264 |
| 8,267,643 | B2 * | 9/2012 | Wagner | F04D 29/2288 415/206 |
| 9,534,601 | B2 * | 1/2017 | Ree | F04D 1/06 |
| 9,863,440 | B2 * | 1/2018 | Pol | E02F 3/9231 |
| 9,897,090 | B2 * | 2/2018 | Burgess | F04D 7/04 |
| 10,458,431 | B2 * | 10/2019 | Stoicescu | F04D 29/4293 |

* cited by examiner

SPLIT VOLUTE FOR SUBMERSIBLE PUMP

CROSS-REFERENCE TO RELATED APPLICATION

This application is a continuation of co-pending non-provisional U.S. patent application Ser. No. 18/054,358, filed Nov. 10, 2022.

TECHNICAL FIELD

The present invention relates to a separable volute for submersible pumping applications in general, and for pumping of solids-containing slurries in particular.

BACKGROUND

Heavy duty centrifugal pumps are a mainstay of applications which present a harsh environment. In one aspect, heavy duty pumps require heavy duty components, especially those components that come into contact with the slurry, such as the volute and impeller. In this context, slurry refers to a mixture of solids suspended in a liquid, usually water, which may be used to transport solids from one area to another. A slurry may contain large particles of dust, dirt and/or rocks—gritty and abrasive materials that erode cast iron and rubber-lined pumps. Additionally, a slurry for applications like mineral mining may cause pump failure from acidic mine water, which corrodes pump components. The conventional manufacturing process for heavy duty volutes is iron casting.

The volute, in particular, is typically cast as a unitary piece of metal, which forms most or all of an interior cavity in a desired shape, for example, a toroidal or snail-shell shape, including openings for insertion of the impeller, the motor shaft and a discharge outlet. Abrasion resistant materials, such as ASTM A532 Type A cast irons, may be used. Such alloys, commonly known as high chrome white irons, contain between about 11% and about 30% Cr, as well as other elements, to promote the presence of carbides in their microstructure. However, as the Cr content in the cast material is increased, the material more difficult to form into complex shapes, such as closed-form volutes, using the conventional casting process. This may lead to a manufacturing yield loss, such as through cracking or other failure modes, and thereby increases the cost of one-piece volutes. Therefore, high Cr content is conventionally avoided as manufacturers opt for more reliable and/or more workable post-cast parts. On that point, some post-processing of the volute, such as surface machining of the interior, is either extremely challenging or not doable, due to the poor machinability of white iron. Therefore, one solution for portions that require machining, such as through holes and tapped blind holes, is to add grey iron preforms or threaded inserts to the casting mold. However, this solution is restricted to surfaces outside of the chamber which do not require the benefit of white iron durability. For interior surfaces another solution must be found.

In yet another aspect, the pump system must withstand harsh operating environments, such as conveying of solids-containing slurries. Hard, granular media, for example, gravel, sand or rocks can wear or otherwise damage pump components, e.g. the impeller and/or volute. As a result, submersible pumps for harsh environments have pump components requiring regular maintenance and/or replacement. In such applications this means hoisting the pump system out of a sump or other wet well environment, disassembly of all pump components below the motor, and inspection, cleaning, repair and/or replacement of the volute and other components before pump system reassembly and return to service. Consequently, there is a need for a submersible pump and system with improved efficiency and reliability and that reduces regular maintenance procedure times, increases the interval between maintenance procedures, and/or reduces the frequency of component replacement.

Accordingly, what is needed is a pump system with enhanced manufacturing, lower component cost, improved reliability, and reduced maintenance resulting in a lower total cost of ownership.

SUMMARY

It is an object of the present invention to provide a volute with enhanced manufacturability, including increased formability and yield in high chrome cast iron and a more accessible interior surface for wear resistant coatings for more complete flow path coverage.

It is an object of the present invention to provide a volute with reduced cost of manufacture via better manufacturing yield and improved reliability via a more complete surface coating.

It is an object of the present invention to provide a volute assembly, system, and method for a submersible pump that provides for reduced and/or easier maintenance.

Other desirable features and characteristics will become apparent from the subsequent detailed description, the drawings, and the appended claims, when considered in view of this background.

DESCRIPTION OF THE DRAWINGS

Non-limiting and non-exhaustive embodiments of the present disclosure are described with reference to the following drawings. In the drawings, like numerals describe like components throughout the several views.

For a better understanding of the present disclosure, reference will be made to the following Detailed Description, which is to be read in association with the accompanying drawings, which are incorporated in and constitute a part of this specification, show certain aspects of the subject matter disclosed herein and, together with the description, help explain some of the principles associated with the disclosed implementations, wherein.

DETAILED DESCRIPTION

Figure 1:
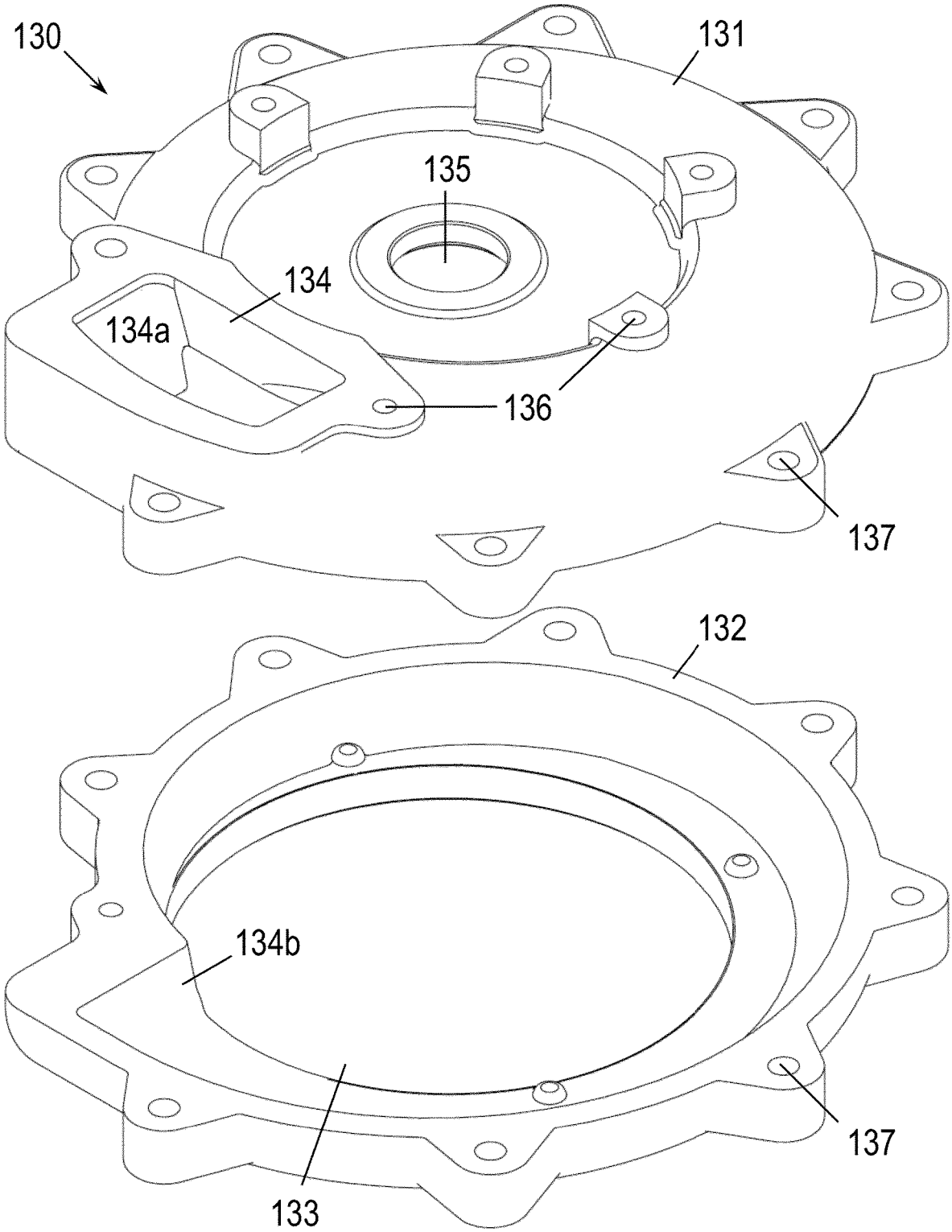
FIG. 1 shows an exploded perspective view of a split volute, according to an embodiment of the present invention.

Non-limiting embodiments of the invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention. The drawings featured in the figures are provided for the purpose of illustrating some embodiments of the invention and are not to be considered as a limitation thereto.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive. Also, the term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

FIG. 1 displays a volute 130 split along a centerline perpendicular to the axis of rotation, forming upper 131 and lower 132 portions. An inlet 133 is formed within the lower portion 132, while an outlet 134 is formed within the upper 131 portion of the volute 130, and the outlet 134 may include an interior shape that redirects the flow in a vertical direction. Fastener openings 137 may be disposed on the periphery of the volute 130 for securing upper and lower portions 131, 132. Motor mounting openings 136 may be disposed on the upper portion 131 with an opening 135 for insertion of the motor shaft.

Figure 2:
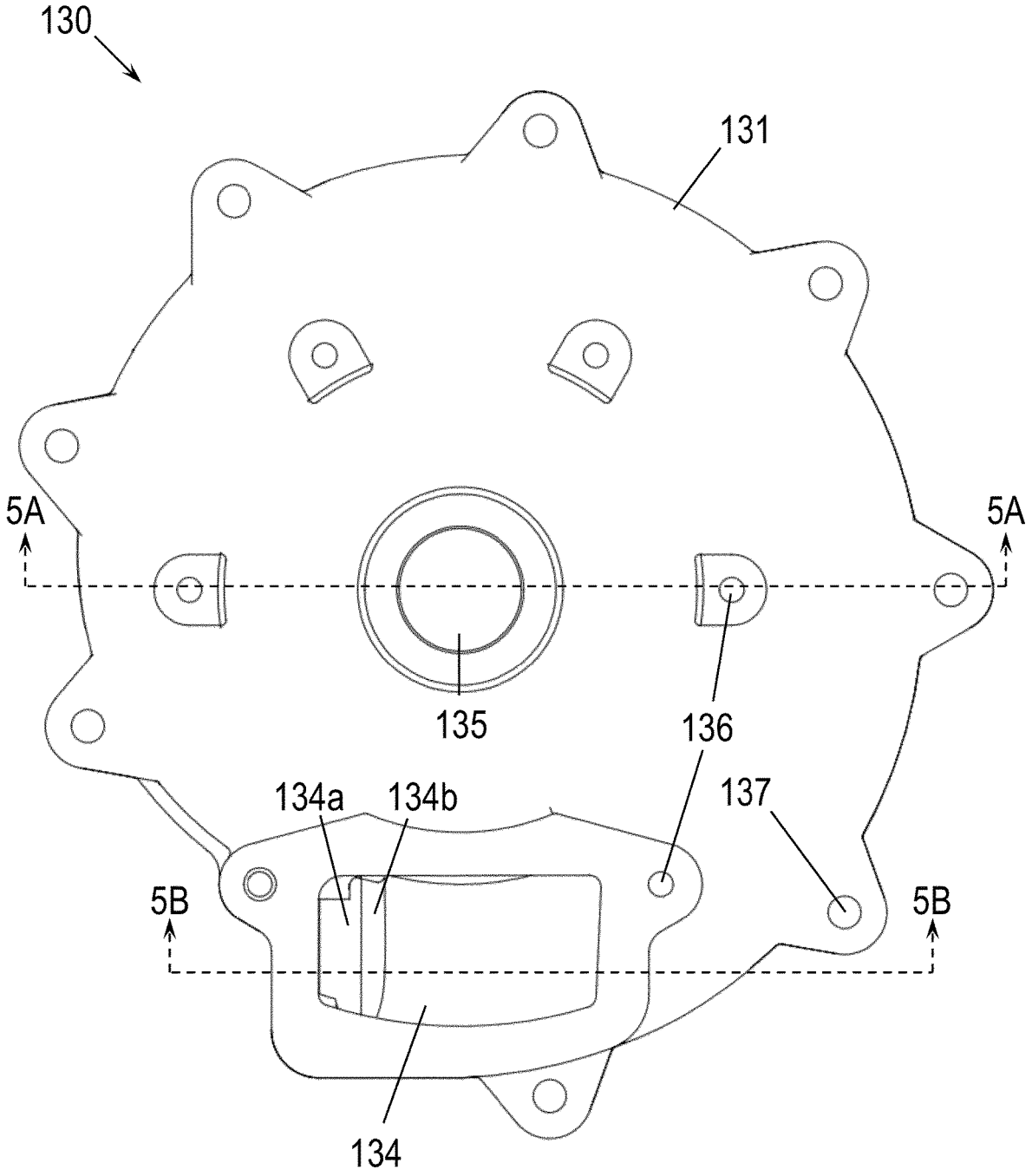
FIG. 2 shows a top view of a split volute, according to an embodiment of the present invention.
Figure 3:
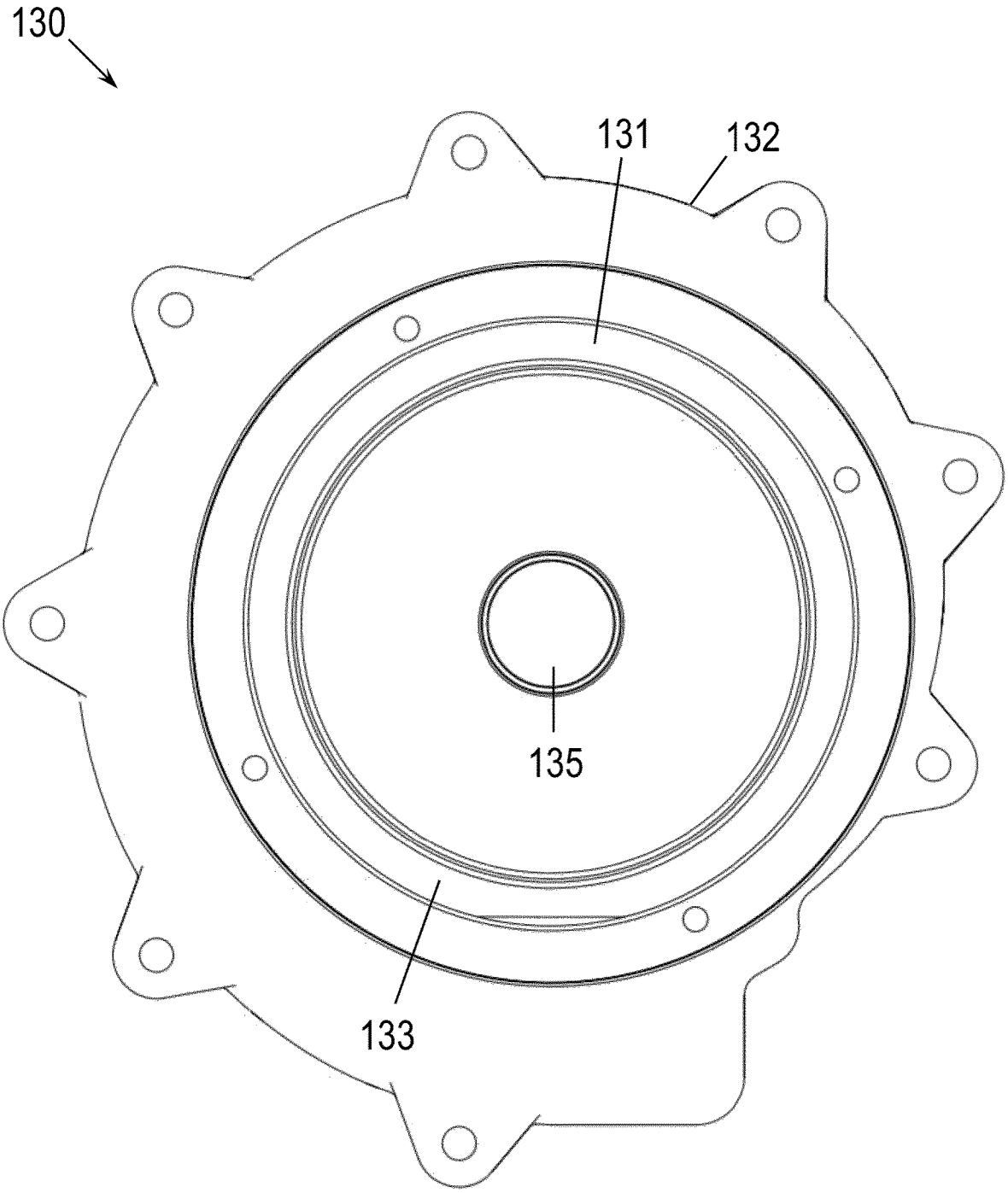
FIG. 3 shows a bottom view of a split volute, according to an embodiment of the present invention.

The assembled volute 130 may be viewed from the top-down, as illustrated in FIG. 2 or from the bottom-up, as illustrated in FIG. 3, with the motor mounting openings 136 radially arrayed with respect to the motor shaft opening 135 in the upper portion 131. Upper 131 and lower fastening openings 137 may extend beyond the edge of the volute 130 circumference for easy access from above. In the embodiment shown, the compact arrangement of the outlet 134 relative to the motor mounts 136 may be clearly seen; the outlet 134 is contained within the profile of the volute 130.

Figure 4A:
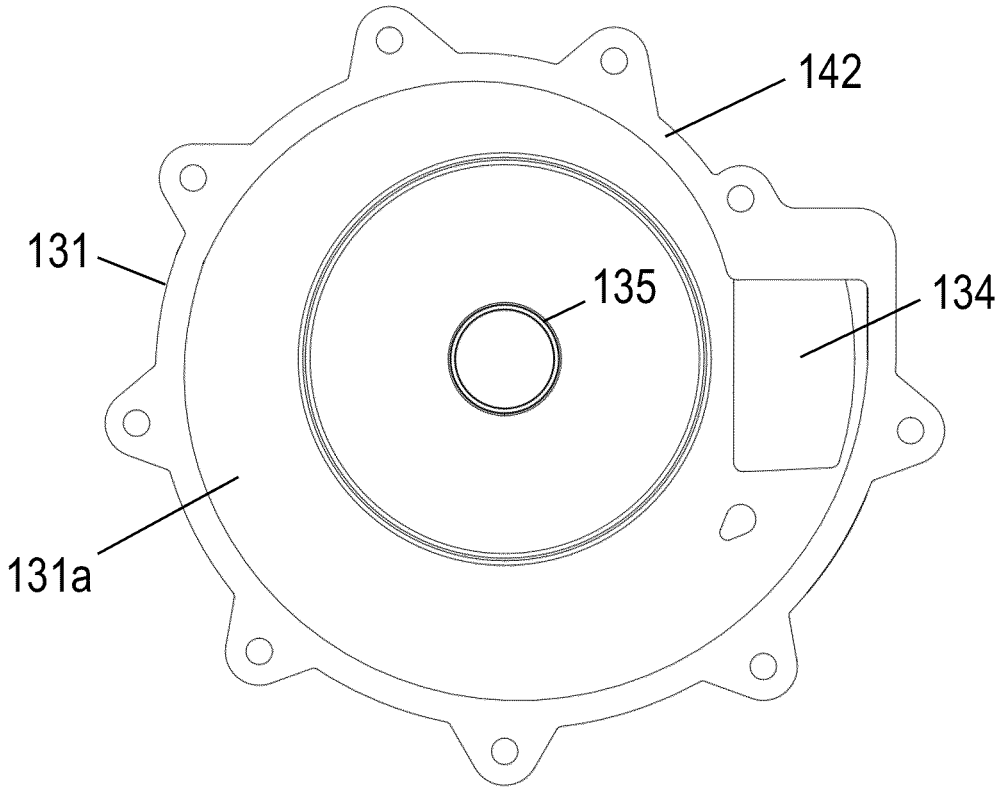
FIG. 4A shows the interior of an upper portion of a split volute, according to an embodiment of the present invention.
Figure 4B:
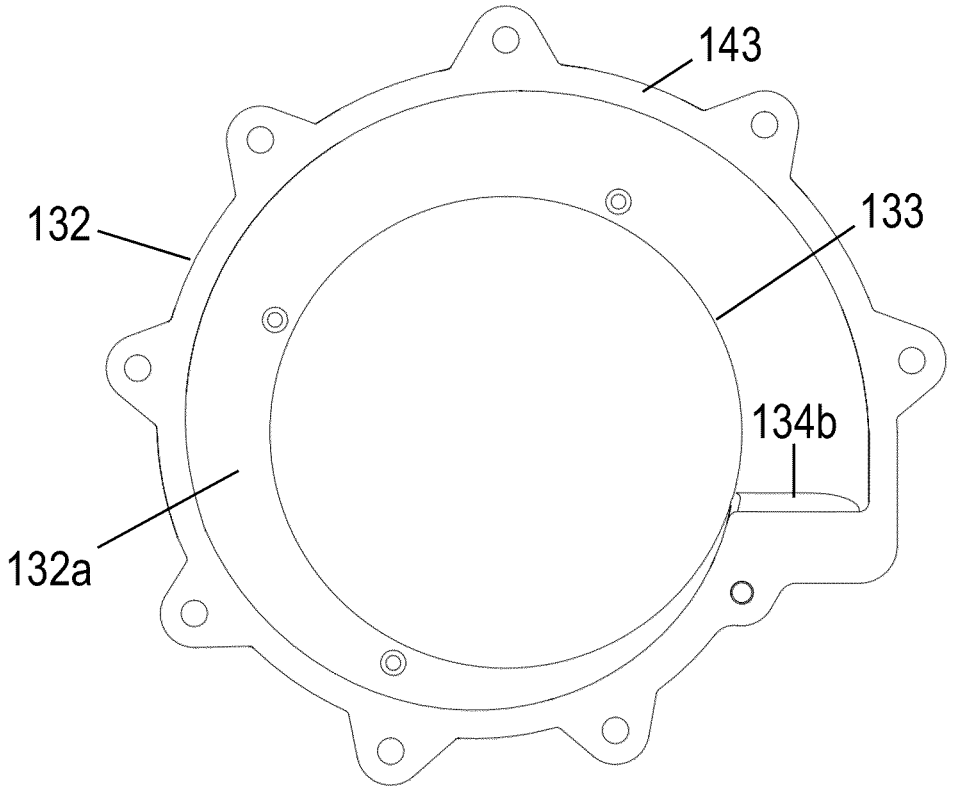
FIG. 4B shows the interior of a lower portion of a split volute, according to an embodiment of the present invention.

Referring to FIGS. 4A and 4B, certain aspects of the inner surfaces of upper and lower portions 131, 132 may be observed. Accordingly, either or both of the upper and lower portions 131, 132 may include one or more inner surfaces 131*a*, 132*a*, respectively. Inner surfaces 131*a* and/or 132*a* may communicate with a fluid, such as a slurry, and may be subject to one or more manufacturing process, as further detailed below. Other surfaces, such as upper lip 142 and lower lip 143 may not directly communicate with said fluid, and therefore may or may not be subjected to such manufacturing processes, but preferably are prepared for another suitable purpose. Upper lip 142 and lower lip 143 may be configured to provide a seal, when upper and lower portions 131, 132 are assembled, for example.

Figure 5A:
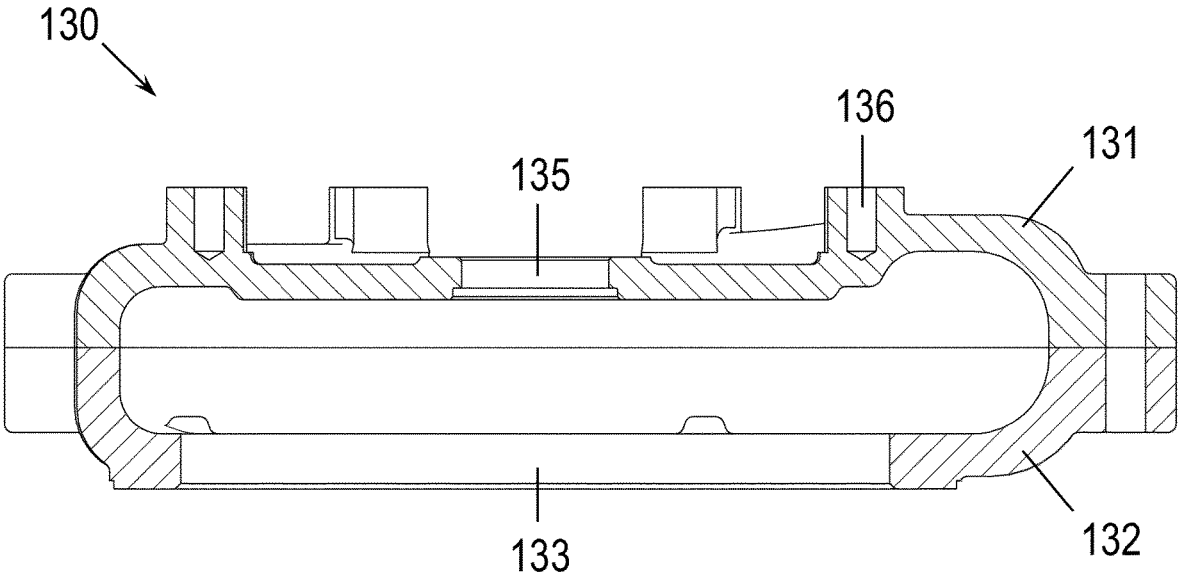
FIG. 5A shows a cross-sectional view of a split volute taken along the line 5A-5A shown in FIG. 2, according to an embodiment of the present invention.

FIG. 5A illustrates a section view of the assembled volute 130 showing the inlet 133 in the lower portion 132 and motor shaft opening 135 in the upper portion 131. The size of the volute chamber may increase in a direction of clockwise flow as viewed from the top and as may be seen in FIG. 5A formed such that the same increases from left to right. The motor mounting openings 136 may be threaded in order to simplify assembly.

Figure 5B:
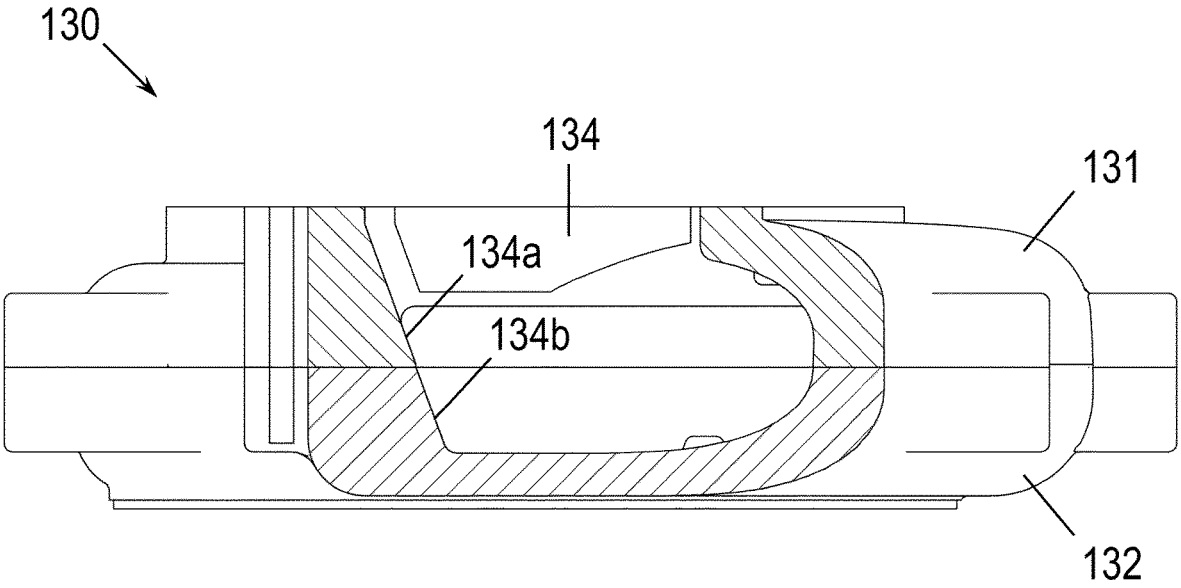
FIG. 5B shows a cross-sectional view of a split volute taken along the line 5B-5B shown in FIG. 2, according to an embodiment of the present invention.

FIG. 5B shows a section view of the assembled volute 130 wherein upper 131 and lower 132 portions combine to form an outlet 134 that may include a tapered profile 134*a-b* that diverts the flow vertically outward from the outlet 134. In this way a more compact lateral pump profile may be obtained.

The disclosed volute provides advantages for manufacturability, performance and maintenance. Regarding manufacturability, in a first aspect, the two-piece construction offers greater castability for high chrome irons, thereby increasing yield and reducing cost. For fields of use contemplated by this disclosure, a variety of cast materials may be used. For example, any white iron may be employed, such as Class I white irons, comprising Cr ranging from about 1.4 percent to about 11 percent. Similarly, Class II white irons, comprising Cr ranging from about 11 percent to about 23 percent may be employed. Also, Class III white irons, comprising Cr ranging from about 23 percent to about 30 percent may be employed. Alternatively, high chrome steel castings may be employed. Alternatively, duplex stainless steel may be employed. However, high chrome white irons are preferable for applications contemplated herein, e.g., for slurry pump applications, because of the wear characteristics, abrasion resistance capacity, ease of casting process, supply resources, post casting processing, and overall cost. Additionally, cobalt-based alloys may be employed. However, they are more suitable for small parts, such as the valve seats employed in reciprocating pump port valves. The lower portion 132 may be configured with one or more interiorly-disposed protrusions which, may be one or more countersink features that aid in the lower portion 132 receiving one or more fasteners, as further described below. Alternatively, the inner surfaces defining either the upper portion 131 or the lower portion 132 may be devoid of such protrusions. In an alternative embodiment, selective locations of the cast, e.g. volute, may comprise a workable material such as ductile iron or gray iron, in the form of an insert, which may be tapped and adapted to receive a fastener. Such tapped openings may further be threaded.

In a second aspect, the split volute grants clear access to all surfaces in the volute cavity. To further harden the volute, an abrasion resistant coating, such as a hard metallic or ceramic material, may be applied to the interior surfaces to reduce wear and extend the life of the volute. Sand blasting may used to prepare the surface for improved adhesion of the coating process. Such coatings may be applied by a number of thermal spray coating methods which work by first subjecting the source material to a high degree of heat to achieve a molten state. The molten material is then atomized into small particles and sprayed outwards onto a surface. Such processes to generate thermal spray coatings include plasma spraying, high velocity oxy-fuel (HVOF) spraying, combustion flame spraying, vacuum plasma spraying, and two-wire electric arc spraying. Coating materials may include tungsten carbide, chromium carbide, chromium oxide, tungsten carbide-cobalt, stainless steel, bronze, alumina-titania, aluminum-graphite composite, aluminum-polyester, and molybdenum-nickel-aluminum, among others. The above thermal spray coating group of methods requires line-of-sight access to all surfaces to be coated, which advantageously the instant invention provides. In this way, the incident process requires reduced labor, time, and cost to produce. In contrast, conventional designs include hard-to-reach areas that remain uncoated and degrade more quickly and reduce the service life of the volute than that of the instant invention.

The open cavity design therefore provides the ability to coat all interior surfaces using the aforementioned spraying techniques, thereby enabling complete and uniform coating at the lowest possible cost. A complete coating prevents premature erosion of any uncoated portions of the volute chamber and extends the service life and/or maintenance interval of the volute. Regarding performance, the compact, vertical nature of the outlet 134, shown in FIG. 6, allows the discharge flow to remain close to the motor casing 120 and thus be used to cool the motor through the casing channel 122. This arrangement may extend the service life and/or maintenance interval of the motor. Furthermore, Applicant has found that conventional designs that utilized removeable rubber inserts are inferior to the processes described herein where, once the removeable linear has degraded, on-site replacement of the liner is often subject to improper and/or faulty installation, which results in poor subsequent durability of the ductile casting/liner assembly. In general, Applicant has found that replacement of the entire volute, once worn, offers a number of advantages, including reliability, cost, reduced downtime.

In an alternative embodiment, selective, localized areas of the interior may be coated with the aforementioned abrasive-resistant coating, such as those areas that are more prone to degradation by abrasion, e.g., impeller tip(s), cutwater. In a further alternative embodiment, components other than the volute and which are exposed to slurry may be coated in any manner disclosed herein such as, for example, impeller 140 and/or wear plate 139. In yet a further alternative embodiment, a rubber coating may be applied in place of the complete coating. Such a rubber coating may be polyethylene or neoprene.

Figure 6:
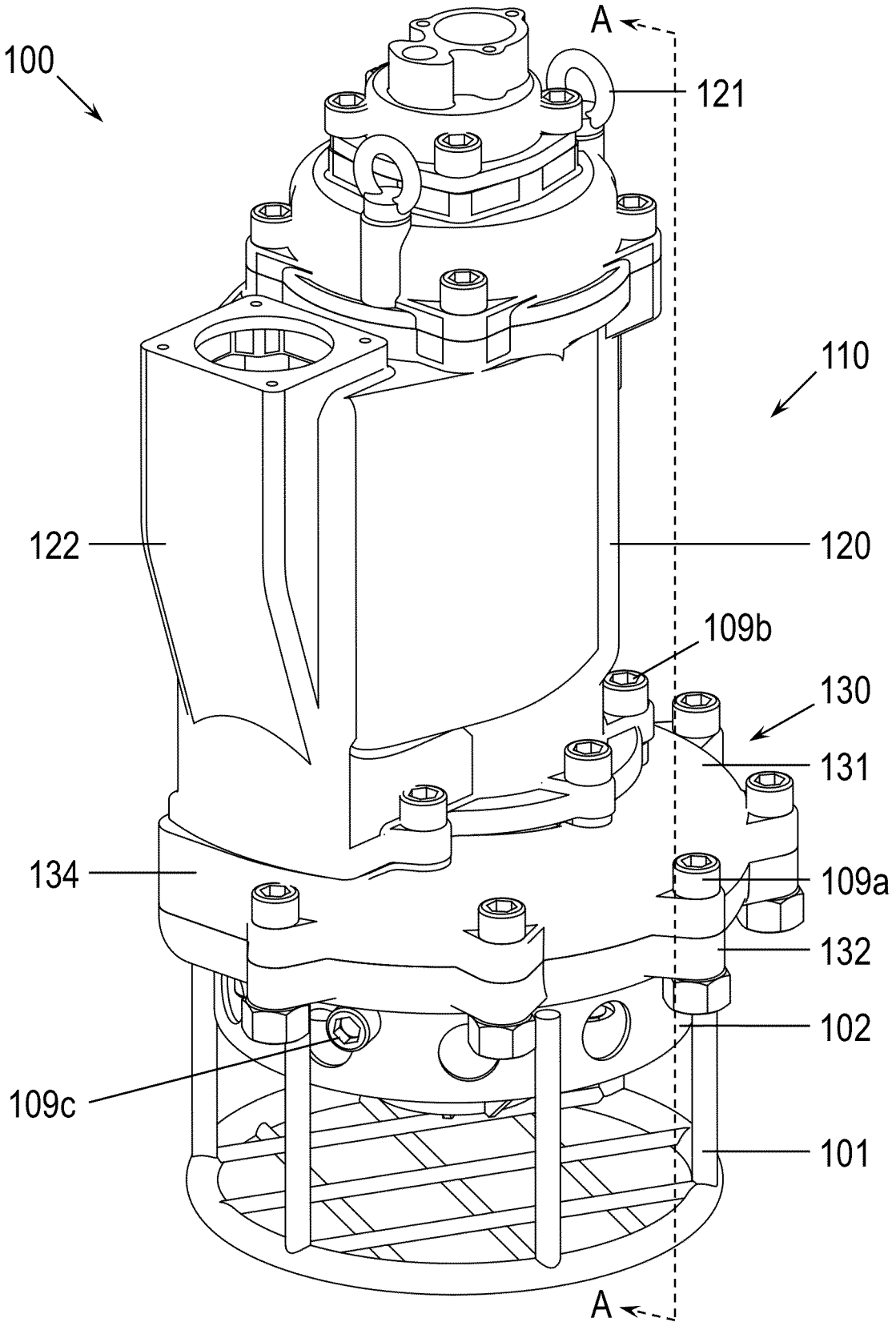
FIG. 6 shows a perspective view of a split volute in the context of a submersible pumping system, according to an embodiment of the present invention.
Figure 7:
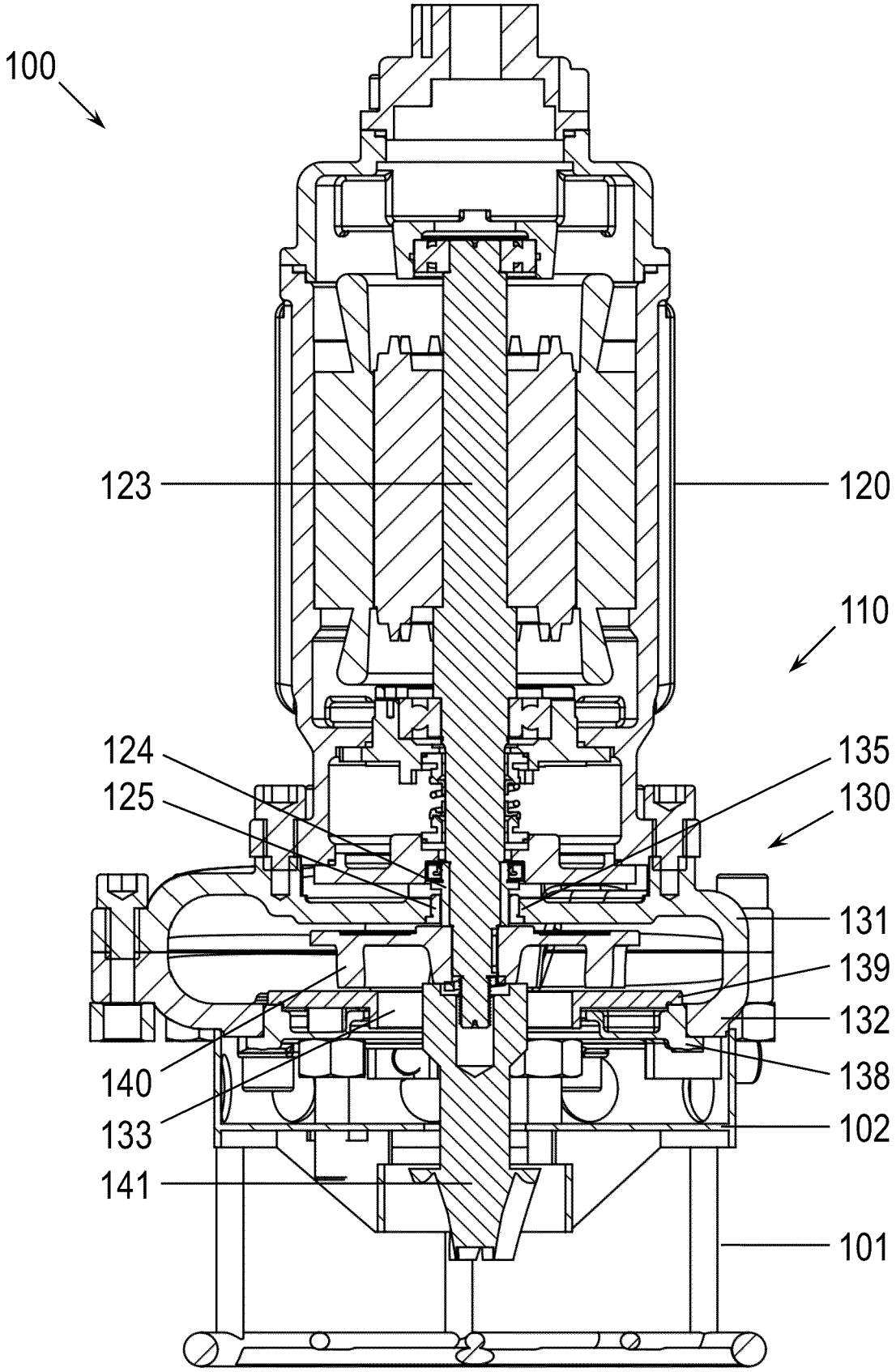
FIG. 7 shows a cross-sectional view of a split volute taken along the line A-A shown in FIG. 6 in the context of a submersible pumping system, according to an embodiment of the present invention.
Figure 8:
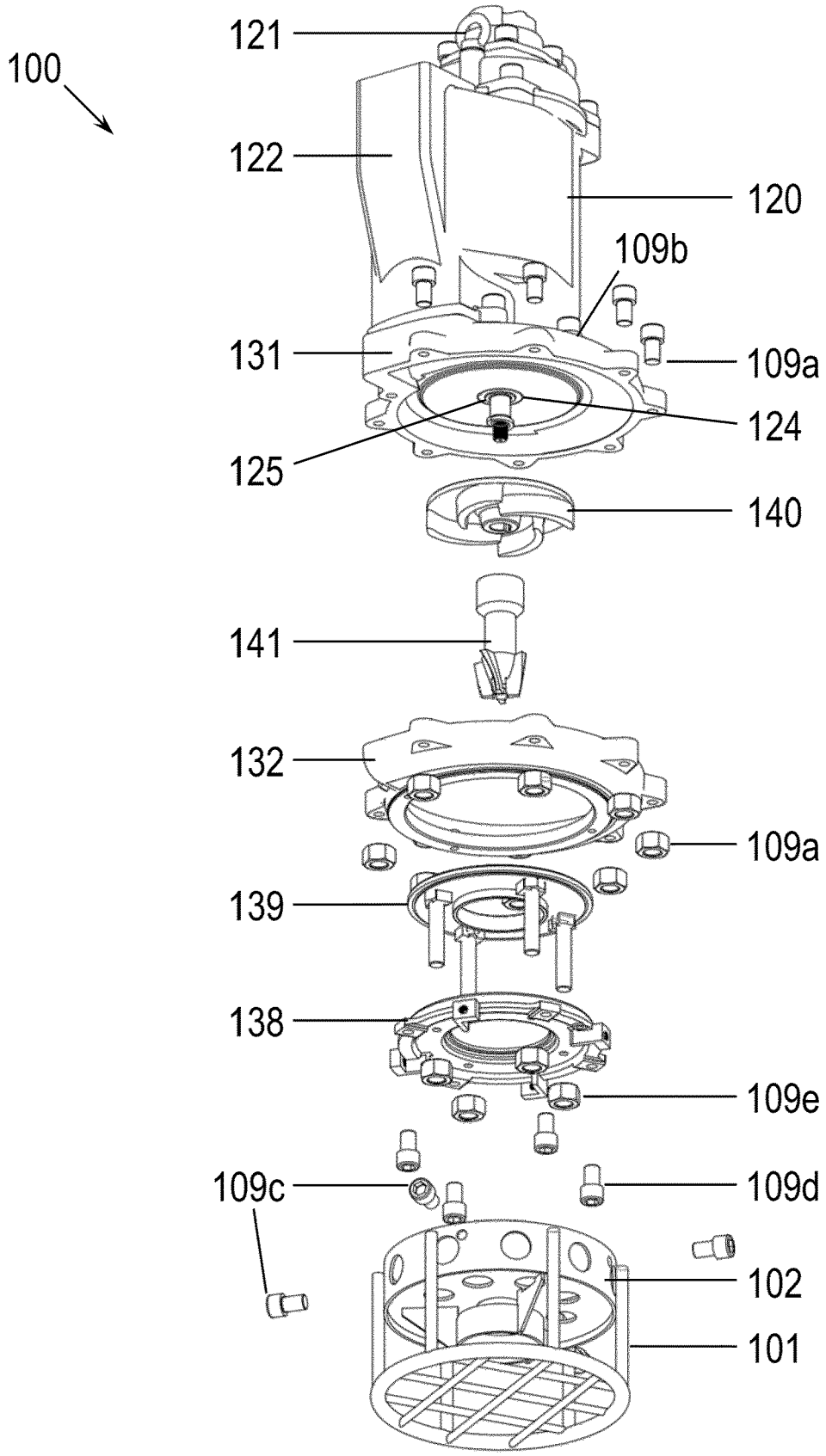
FIG. 8 shows an exploded perspective view of a split volute in the context of a submersible pumping system, according to an embodiment of the present invention.

The volute may be integrated into a pump system 100, as shown in FIGS. 6-8. The pump system 100 comprises a pump assembly 110, which includes the motor 120 and volute 130. The upper 131 and lower 132 portions of the volute may be assembled with, for example, eight fasteners 109*a* and the volute 130 may be assembled to the motor with, for example, six fasteners 109*b*. The pump system 100 may further include a stand 101 and strainer 102 assembly, wherein the stand 101 and strainer 102 may be welded together. The stand 101 may create a flow space beneath the pump assembly so as to prevent the inlet from resting on the bottom of the sump. The strainer 102 may inhibit objects of a sufficient size capable of jamming, or otherwise restricting movement of the pump assembly 100 from reaching the inlet. The stand 101 and strainer 102 may be bolted to the bottom of the volute assembly 130 with one or more fasteners 109*c*. The vertical outlet of the volute 134 feeds a discharge channel 122 which cools the motor 120. This configuration of the outlet 134 enables a compact lateral profile for the pump assembly 110, allowing it to fit into a variety of confined spaces, such as a sump, while keeping the center-of-gravity near the motor axis for ease of handling. Hoist rings 121 are positioned for ease of access when being raised or lowered.

The cross-sectional view of FIG. 7 illustrates additional aspects of pump system 100 including a split volute 130. The upper portion of the volute 131 comprises a shaft opening 135 which may be fitted with a volute sleeve 125. The motor shaft 123 may be fitted with a shaft sleeve 124, which may be inserted into the volute sleeve 125. The shaft 123 rotates within the shaft sleeve 124, which may be stationary against the volute sleeve 125. A portion of the shaft 123 sits within the volute chamber and serves as a spindle for the impeller 140 and agitator 141. The impeller 140 may be fixedly coupled to the drive shaft 123 by a key, pin, fastener, or other mechanical method. The agitator 141 may be coupled to a threaded portion of the drive shaft 123 and may be adapted to rotate accordingly. The agitator 141 protrudes beyond the inlet 133 of the volute 130 to a point above the base of the stand 101. The function of the agitator 141 is to stir or agitate the fluid and/or slurry, thereby promoting the creation of a uniform mixture and avoid settling of solids from the fluid, to thereby be evacuated by the pump system 100 out of the wet environment, e.g., sump. A suction cover 138 and a wear plate 139 forming a subassembly may be affixed to the bottom portion of the volute 132, to form a portion of the bottom of the volute chamber 130. The assembly of the suction cover 138 and wear plate 139 further acts to restrict the size of the inlet 133 to match the draw diameter of the impeller 140, which is to say that the wear plate 139 provides a mechanism to draw slurry proximate the center of the impeller, while forming part of the restricted flow path that allows the impeller to function appropriately. The components most exposed to the wearing effects of the slurry include the agitator 141, suction cover 138, wear plate 139, impeller 140 and volute interior surfaces 131*a*, 132*a*. Some exposure and resulting wear also occurs for the shaft 124 and volute 125 sleeves.

Figure 9:
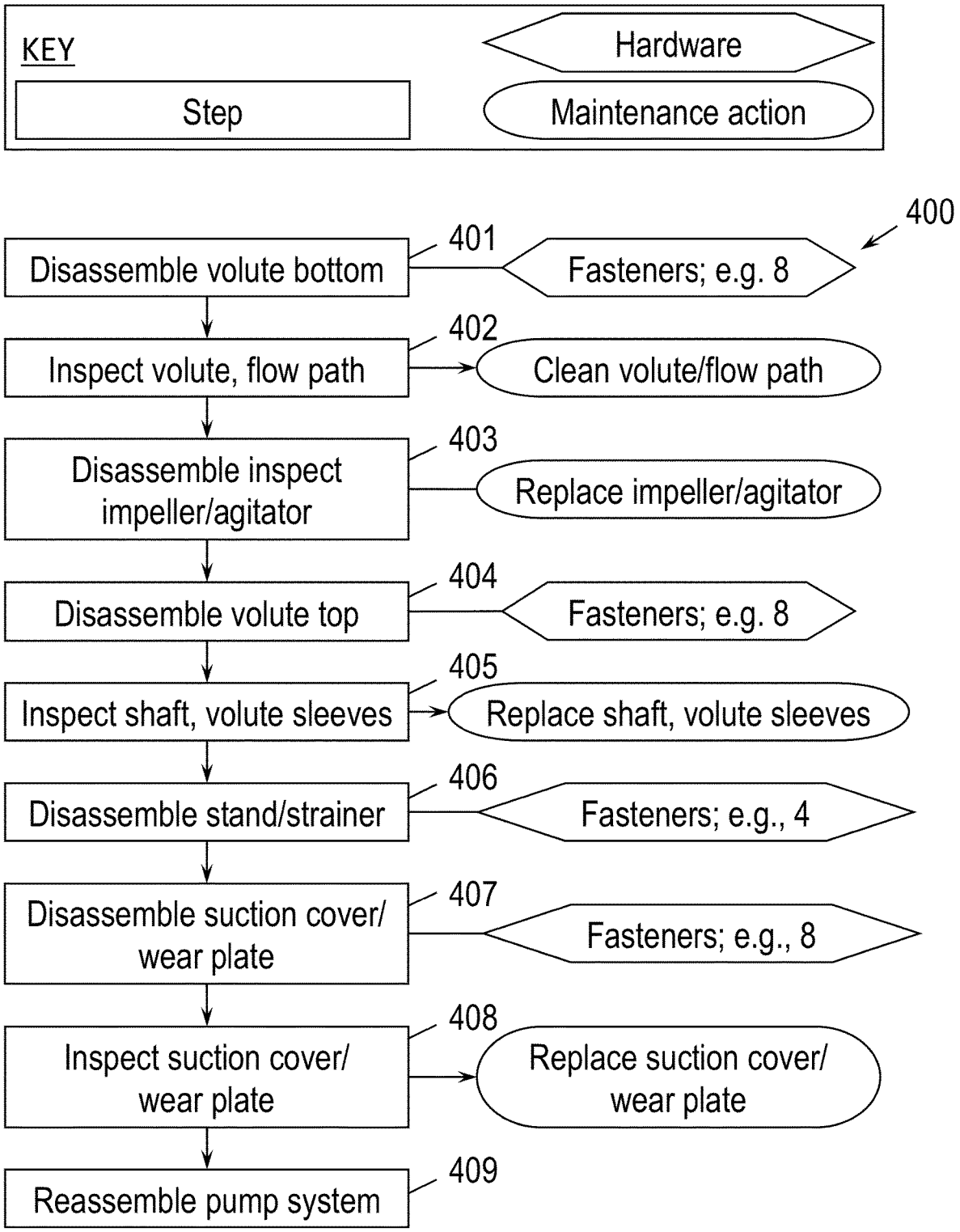
FIG. 9 shows a process flow diagram of an exemplary maintenance procedure for a split volute assembled into a submersible pumping system, according to the present invention.
Figure 10:
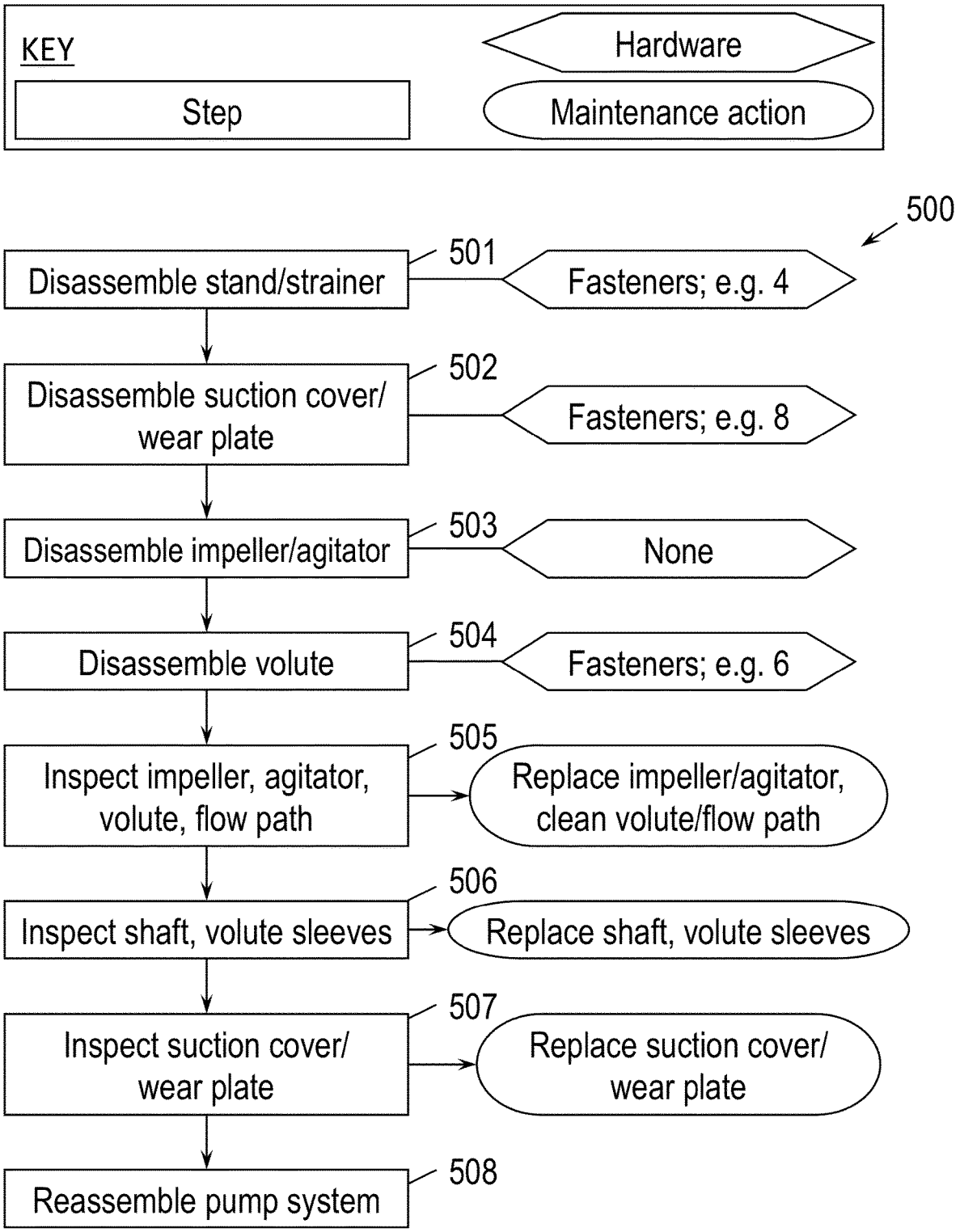
FIG. 10 (Prior Art)
FIG. 10 shows a process flow diagram of an exemplary maintenance procedure for a unitary volute assembled into a submersible pumping system, according to the prior art.

The disclosed volute further provides advantages for inspection and maintenance of the pump system 100 and components thereof, as illustrated in FIGS. 8 through 10. FIG. 8 displays the component disassembly process for a pump system 100 maintenance operation. For proper maintenance the components that are exposed to the pumped slurry and/or experience high wear must be regularly inspected and/or replaced. In order of frequency, those components that typically require inspection and/or replacement comprise: (1) the impeller 140 and/or agitator 141; (2) the volute 130 and discharge flow path 134, 122; (3) the suction cover 138 and wear plate 139, and (4) the volute and shaft sleeves 124, 125. It is standard practice to disassemble the pump system to the point where each of the above items may be inspected and possibly cleaned or replaced during each maintenance procedure.

One or more methods of disassembly and/or repair 400 of the pump system 100 are provided in FIG. 9. Prior to disassembly, the entire pump system 100 may be lifted out of the sump using hoist rings 121 and placed in a dry environment. For the case of the disclosed split volute 130 and according to one aspect of the present invention, FIG. 9 therefore gives the maintenance steps and an exemplary number of fasteners for disassembly, as may be required, along with any maintenance action, also as may be required.

In a first step 401, the lower portion 132 of volute 130 may be lowered by removing fasteners 109*a*. The upper portion 131 of volute 130 may remain bolted to the motor 120. Dismantling the lower portion 132 of volute 130 provides access and full visibility for the second step 402, which is to inspect the volute 130 fluid passage, including outlet 134 and discharge channel 122, for any wear and tear incurred during pump operation. Advantageously, and as an optional part of step 401 as needed, the volute chamber 130, outlet 134 and discharge channel 122 may be easily cleaned due to the high degree of accessibility provided by the split volute 130. In a third step 403, the impeller 140 and/or agitator 141 may be removed and inspected. If replacement of impeller 140 and/or agitator 141 is warranted, such replacement is delayed until the completion of the fourth 404 and fifth 405 steps. In a fourth step 404, the upper portion 131 of the volute may be disassembled by removing fasteners 109*b*. In a fifth step 405, the shaft and volute sleeves 124, 125 may be inspected and/or replaced. Notably, the operable surfaces of the shaft sleeve 124 do not contact the pump slurry and only wear against the motor shaft 123. Furthermore, only the chamber-side surface of the volute sleeve 125 contacts the slurry and wears slowly due to its shielded position in the chamber 130. Because of this, the wear on the shaft 125 and volute 124 sleeves is more predictable and may only be a function of the number of operating hours of the motor 120. For this reason, steps 404 and 405 may or may not be performed during each maintenance cycle, depending on the cumulative operating hours of the pump system with a particular shaft sleeve 125. This may considerably shorten the time required for the maintenance procedure. In a sixth step 406, the stand/strainer 101/102 assembly is removed via four fasteners from the lower portion 132. In a seventh step 407, the suction cover 138 and wear plate 139 are disassembled via fasteners 109*d*, 109*e*, also from the lower portion 132. This gives visual access for the eighth step 408, which is inspection of the suction cover 138 and wear plate 139, which may be replaced as necessary. Finally, in a ninth step 409, all components are reassembled, and the system is lowered back into the wet environment, e.g., the sump. While the specific number of fasteners, e.g., 109*a*, 109*b*, may vary from that shown in the drawings representing the various embodiments presented herein, the number of fasteners covering these various embodiments shall be construed as nonlimiting. Therefore, any number of fasteners may be utilized corresponding to each applicable component. For example, the lower portion 132 of volute 130 may be provided with 8 fasteners 109*a*; the upper portion 131 of volute 130 may be provided with 6 fasteners 109*b*; the stand 101 and strainer 102 may be provided with 4 fasteners 109*c*; and the wear plate 139 may be provided with 8 fasteners 109*d*, 109*e*. These quantities are useful in describing advantages of the present invention, in conjunction with the following conventional comparison.

For the case of a conventional, unitary volute, FIG. 10 gives the maintenance steps 500 and number of fasteners for disassembly, if required, along with any maintenance action, if necessary. In a first step 501, the stand/strainer 101/102 assembly is removed via four fasteners 109*c*. In a second step 502, the suction cover 138 and wear plate 139 are removed via eight fasteners 109*d*, 109*e*. In a third step, the impeller 140 and agitator 141 are removed. In a fourth step 504, the volute 130 is removed by disassembling six fasteners 109*b*. In a fifth step 505, the full flow path, including the volute 130, outlet 134 and discharge channel 122 may be inspected and/or cleaned. However, some parts of the volute may be difficult to reach because of the relatively closed geometry, as previously discussed. Also in this step 505, the impeller 140 and agitator 141 may be inspected. If replacement is warranted it is delayed until the completion of the sixth step 506. In a sixth step 506, the volute and shaft sleeves 124, 125 may be removed, inspected and, if necessary, replaced. A seventh step 507 includes inspection of the suction cover 138 and wear plate 139, which may be replaced as necessary. Finally, in an eighth step 508, all components are reassembled, and the system is put back into the service environment.

Some advantages of the present invention from a maintenance perspective may now be apparent. First, disassembly of only eight fasteners is required to open the volute and inspect the flow path and impeller/agitator, which are the most commonly worn or damaged components of the pump system. In contrast, the conventional unitary volute requires full disassembly, including eighteen fasteners, before the flow path is fully accessible. Even after full disassembly, a unitary volute is more challenging to inspect and clean than a split volute 130. Second, handling of the split volute 130 is easier than handling of a unitary volute. Given that the volute in a slurry pump system is a large, cast-iron component, it can be quite heavy and difficult to maneuver. In the case of the split volute 130, maintenance personnel are required to handle only a portion of the weight of the volute at any one time. Third, for an abbreviated maintenance procedure, i.e. one that does not include inspection of the shaft or volute sleeves, suction cover or wear plate, only the eight volute fasteners need disassembly, which is less than the eighteen required in the case of the one-piece volute. Thus, the present invention significantly reduces the required time and effort to perform a maintenance procedure compared with a conventional, one-piece volute.

Therefore, the split volute 130 according to the present invention provides a manufacturing advantage by improving the casting yield of high-chrome iron and providing for full surface coating capability using standard, line-of-sight spray coating systems. These factors translate into a volute-component cost savings which further translates into a system cost savings. In addition, these manufacturing improvements enable performance improvements including improved pump efficiency, abrasion resistance and volute lifetime. Finally, operational cost savings are enabled through reduced time required for common volute maintenance procedures and an increased replacement interval for the volute. Taken together, these advantages reduce the total cost of ownership of the split volute pump system.

The previous description of the disclosed embodiments is provided to enable any person skilled in the art to make or use the invention. Various modifications to these embodiments will be readily apparent to those skilled in the art, and the principles defined herein can be applied to other embodiments without departing from the spirit or scope of the invention. It is therefore desired that the present embodiments be considered in all respects as illustrative and not restrictive, reference being made to the appended claims as well as the foregoing descriptions to indicate the scope of the invention.

What is claimed is:

1. A volute for a submersible pump for pumping a slurry, the volute comprising:

an upper portion including one or more upper inner surfaces; and a lower portion including one or more lower inner surfaces, and a centrally-disposed inlet, when in an assembled configuration, said lower portion hermetically, operably couples to said upper portion thereby forming a chamber defined at least in part by said one or more upper inner surfaces and said one or more lower inner surfaces, said lower portion and said upper portion further comprising an outlet characterized by one or more redirecting surfaces, wherein a flow moves sequentially through the volute as follows: axially through said centrally-disposed inlet in said lower portion, then radially through said chamber, and then axially through said outlet, said axial and radial directions being established by the volute, such that said chamber and said outlet are contiguous to thereby allow said radial flow to move unobstructed from said chamber to said outlet while said flow is moving in the radial direction through said chamber.

2. The volute as recited in claim 1, wherein said lower and upper portions are assembled with one or more fasteners.

3. The volute as recited in claim 1, wherein said volute comprises a cast iron alloy material.

4. The volute as recited in claim 3, wherein said material comprises a high-chrome white iron.

5. The volute as recited in claim 4, wherein said material comprises iron including between about 11% to about 30% Cr content.

6. The volute as recited in claim 1, wherein said volute comprises a high-chrome steel alloy material.

7. The volute of claim 1 wherein said surfaces are coated with one or more wear-resistant coating processes which require line-of-sight access to the surfaces to be coated.

8. A method of manufacturing a volute for a submersible pump for pumping a slurry, the method comprising:

casting an upper portion including one or more upper inner surfaces; and casting a lower portion including one or more lower inner surfaces, and a centrally disposed inlet;

wherein, in an assembled configuration, said upper and lower portions hermetically couple to form a chamber defined at least in part by said one or more upper inner surfaces and said one or more lower inner surfaces, said upper and lower portion further comprising an outlet characterized by one or more redirecting surfaces, wherein said volute is adapted for moving a flow sequentially through the volute as follows: axially through said centrally-disposed inlet, then radially through said chamber, and then axially through said outlet, said axial and radial directions being established relative to said volute, such that said chamber and said outlet are contiguous to thereby allow said radial flow to move unobstructed from said chamber to said outlet while said flow is moving in the radial direction through said chamber.

9. The method of claim 8 wherein said one or more redirecting surfaces are disposed at a non-orthogonal angle with respect to both said circular flow and said outlet flow.

10. The method of claim 8 wherein said chamber includes surfaces contacting said flow, the method further comprising the step of coating said surfaces with one or more wear-resistant coating processes which require line-of-sight access to the surfaces to be coated.

11. The volute as recited in claim 10, wherein said one or more wear-resistant coating processes are selected from the group consisting of: plasma spraying, high velocity oxy-fuel (HVOF) spraying, combustion flame spraying, vacuum plasma spraying, and two-wire electric arc spraying.

12. The volute as recited in claim 11, wherein said one or more wear-resistant coating processes apply a material selected from the group consisting of: tungsten carbide, chromium carbide, chromium oxide, tungsten carbide-cobalt, stainless steel, bronze, alumina-titania, aluminum-graphite composite, aluminum-polyester, and molybdenum-nickel-aluminum.

13. The method of manufacturing a volute for a submersible pump as recited in claim 8, wherein said lower and upper portions comprise a cast iron alloy material.

14. The method of manufacturing a volute for a submersible pump as recited in claim 13, wherein said material comprises a high-chrome white iron.

15. The method of manufacturing a volute for a submersible pump as recited in claim 14, wherein said material comprises iron including between about 11% to about 30% chromium content.

16. The method of manufacturing a volute for a submersible pump as recited in claim 8, wherein said volute comprises a high-chrome steel alloy material.

* * * * *